US011865427B2

(12) United States Patent
Hong

(10) Patent No.: US 11,865,427 B2
(45) Date of Patent: Jan. 9, 2024

(54) GOLF SWING NOTIFICATION DEVICE

(71) Applicant: Myong Gi Hong, Anyang-si (KR)

(72) Inventor: Myong Gi Hong, Anyang-si (KR)

( * ) Notice: Subject to any disclaimer, the term of this patent is extended or adjusted under 35 U.S.C. 154(b) by 209 days.

(21) Appl. No.: 17/423,949

(22) PCT Filed: Aug. 19, 2020

(86) PCT No.: PCT/KR2020/011004

§ 371 (c)(1),
(2) Date: Jul. 19, 2021

(87) PCT Pub. No.: WO2021/060710

PCT Pub. Date: Apr. 1, 2021

(65) Prior Publication Data

US 2022/0126187 A1 Apr. 28, 2022

(30) Foreign Application Priority Data

Jun. 29, 2019 (KR) ..... 10-2019-0118769
Jan. 15, 2020 (KR) ..... 10-2020-0005296
Jul. 20, 2020 (KR) ..... 10-2020-0089700

(51) Int. Cl.
*A63B 69/36* (2006.01)
*A63B 71/06* (2006.01)

(52) U.S. Cl.
CPC ..... *A63B 71/06* (2013.01); *A63B 69/36* (2013.01); *A63B 2220/833* (2013.01); *A63B 2225/50* (2013.01)

(58) Field of Classification Search
None
See application file for complete search history.

(56) References Cited

U.S. PATENT DOCUMENTS

2011/0230985 A1* 9/2011 Niegowski ..... A43B 5/16 700/91
2015/0127125 A1* 5/2015 Chung ..... G06Q 10/10 700/91

FOREIGN PATENT DOCUMENTS

| | | |
|---|---|---|
| KR | 10-1081121 | 11/2011 |
| KR | 10-2015-0066769 | 6/2015 |
| KR | 10-2016-0141485 | 12/2016 |
| KR | 10-2019-0057613 | 5/2019 |
| KR | 10-2019-0103781 | 9/2019 |

* cited by examiner

*Primary Examiner* — Sunit Pandya
(74) *Attorney, Agent, or Firm* — LEX IP MEISTER, PLLC

(57) ABSTRACT

The present invention relates to a golf swing notification device for notifying a person who has made a golf swing and other team members of golf swing information (information indicating that the golf swing has been made by a certain fellow golfer) during a round of golf. According to the present invention, a caddie and other fellow golfers are able to know that a golf swing has been made by a fellow golfer, so as to be warned to not be struck by a golf ball. In particular, the present invention is very useful in that it has an accumulated strokes notification and check function that enables a golfer and other fellow golfers to be notified of stroke count at all times during a round of golf, and also has a hole accumulated number of strokes reset function, a hole information notification function, a penalty stroke correction function, a hitting position display function, a hole score notification function, and the like.

18 Claims, 12 Drawing Sheets

【FIG.1】
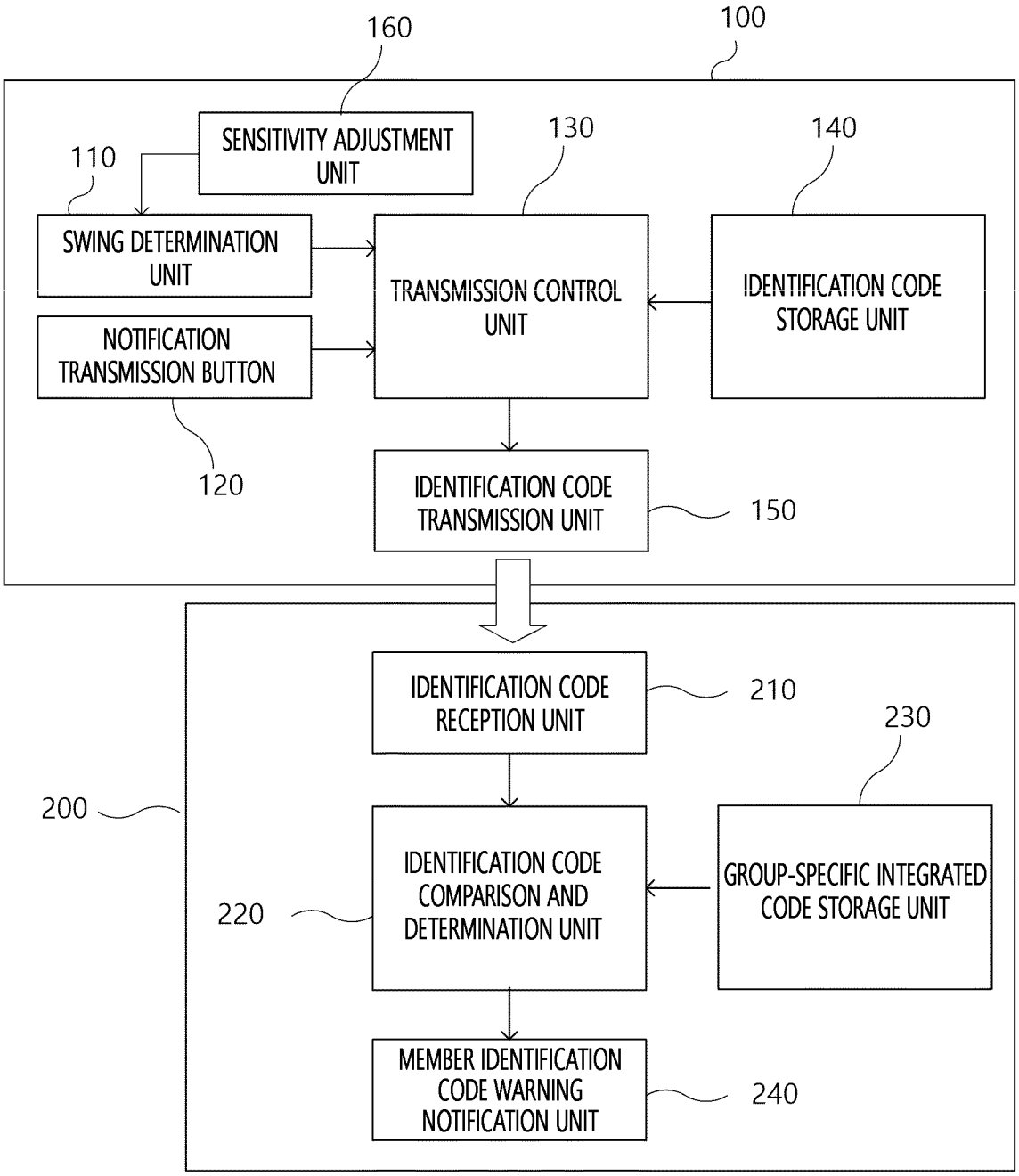

【FIG.2】
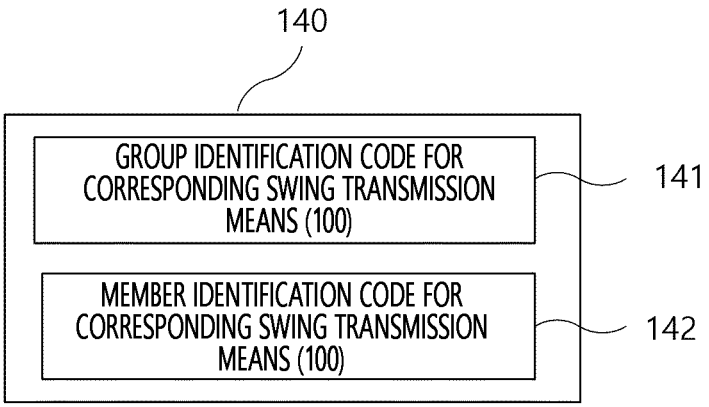
【FIG.3】
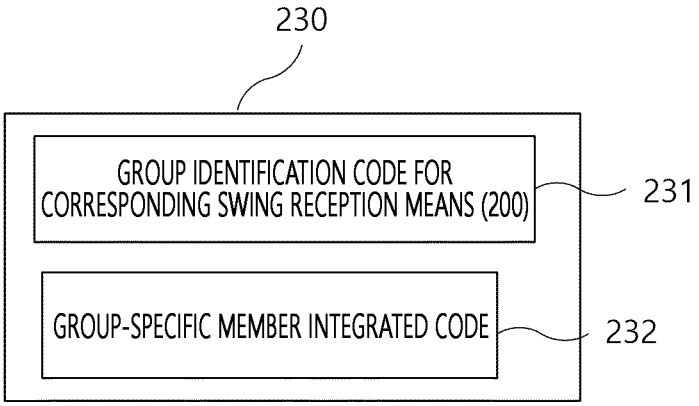

【FIG.4】
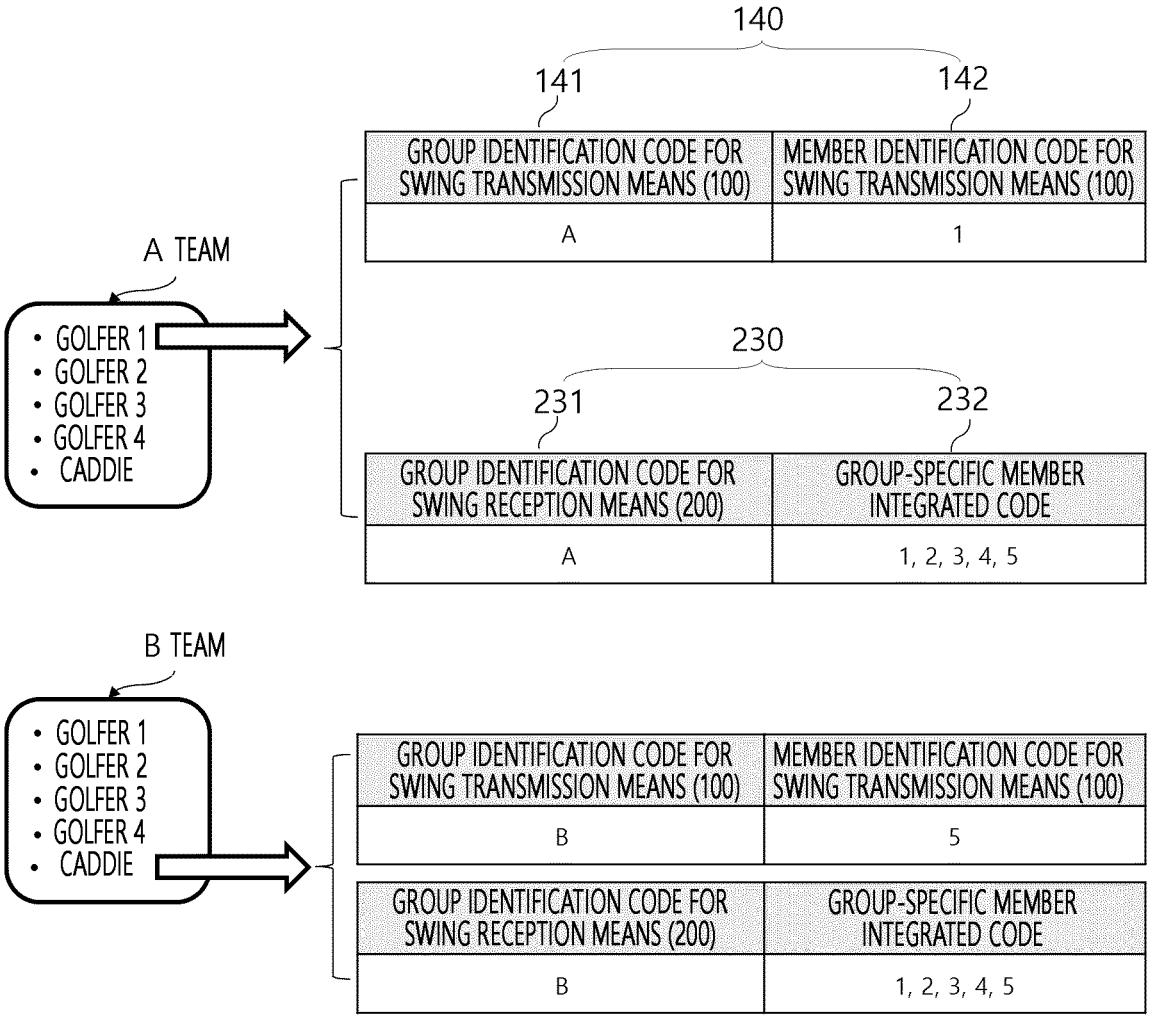

【FIG.5】
(a)
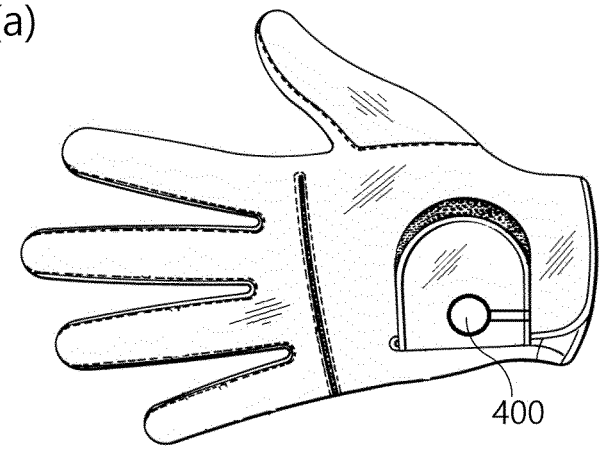
(b)
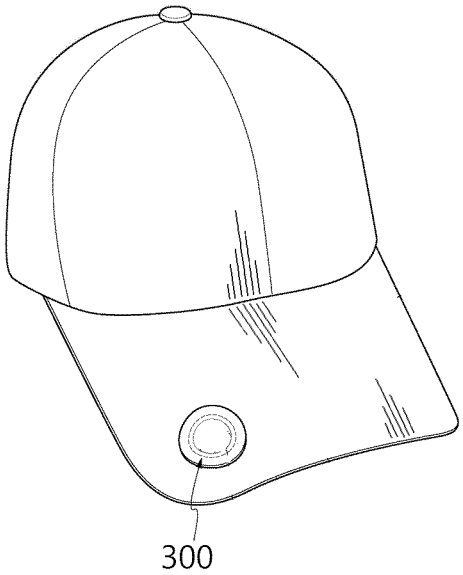

【FIG.6】
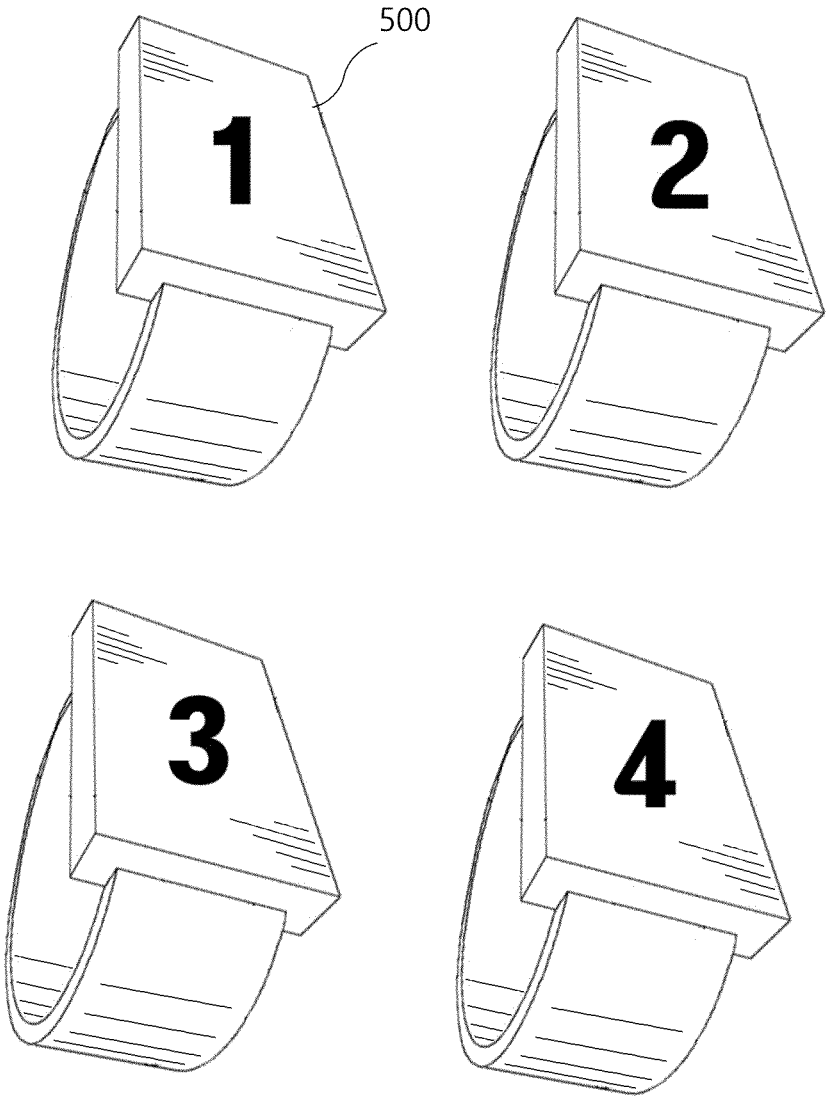

【FIG.7】
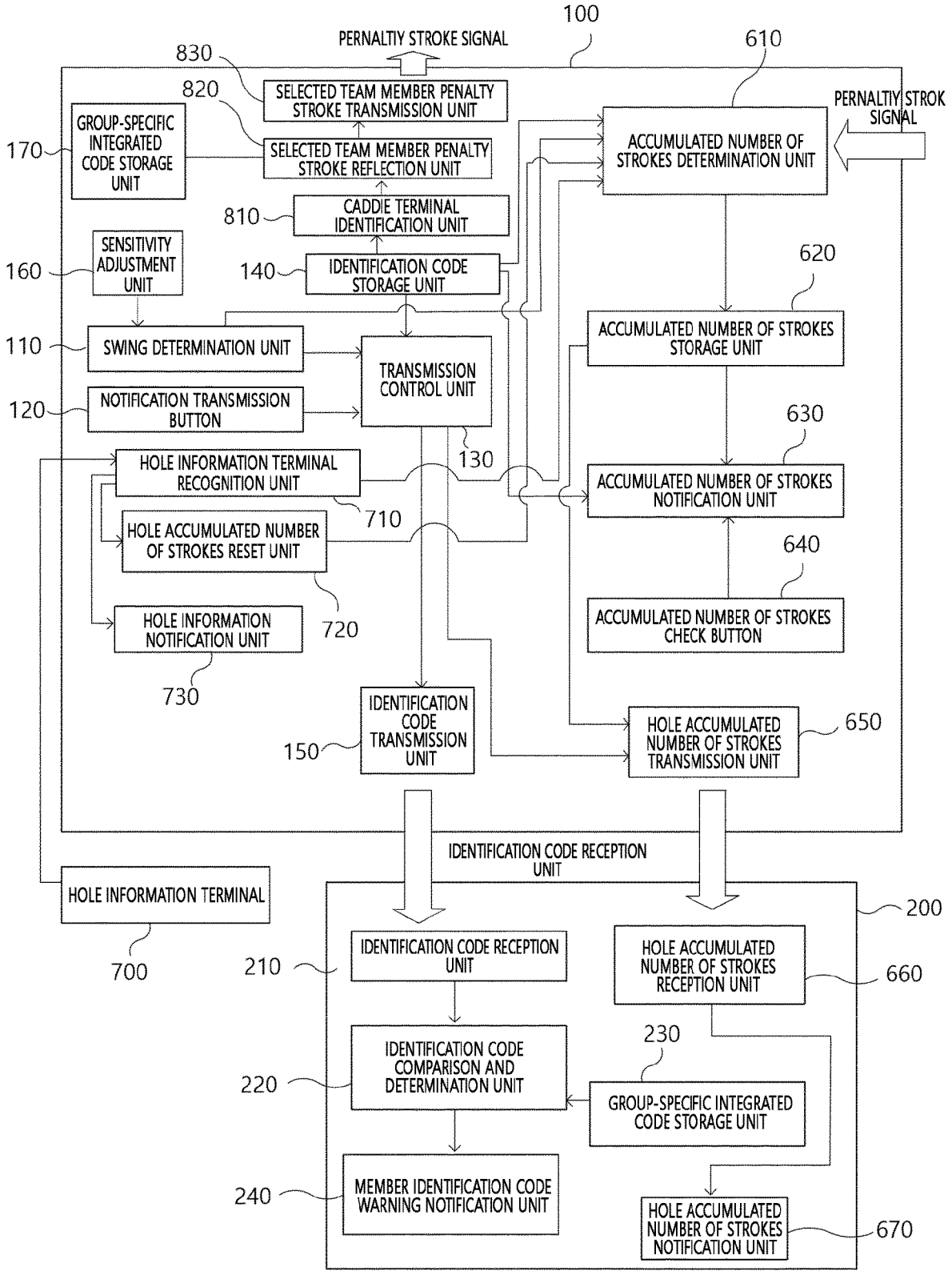

【FIG.8】
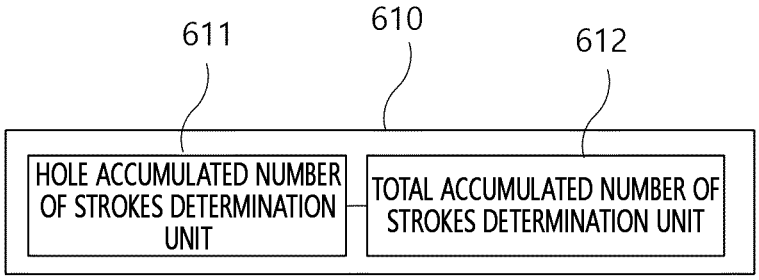
【FIG.9】
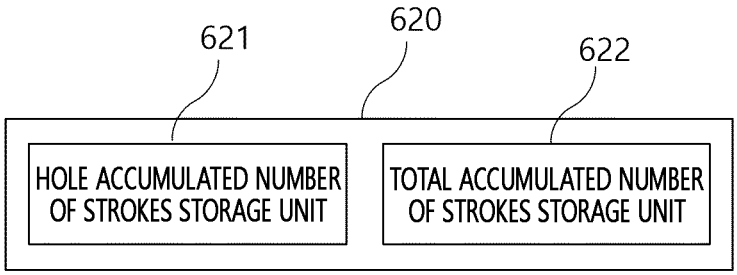
【FIG.10】
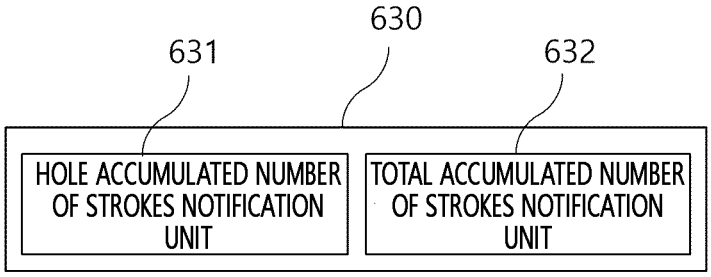
【FIG.11】
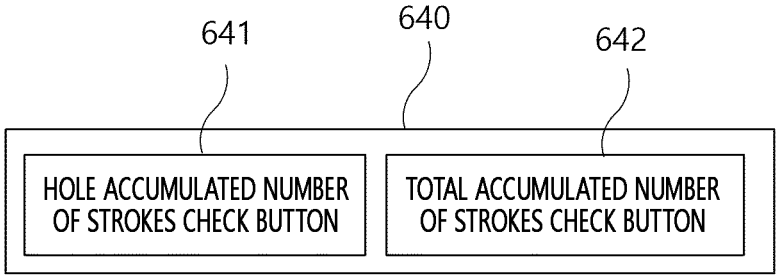

【FIG.12】
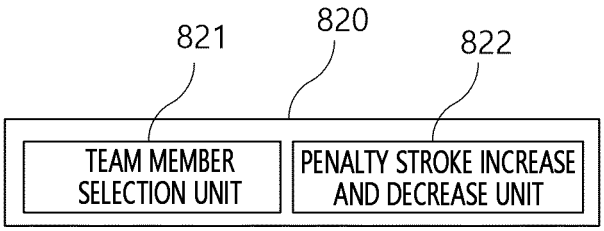
【FIG.13】
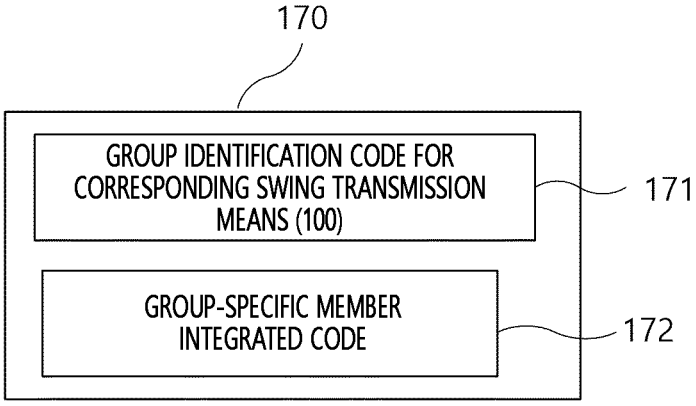
【FIG.14】
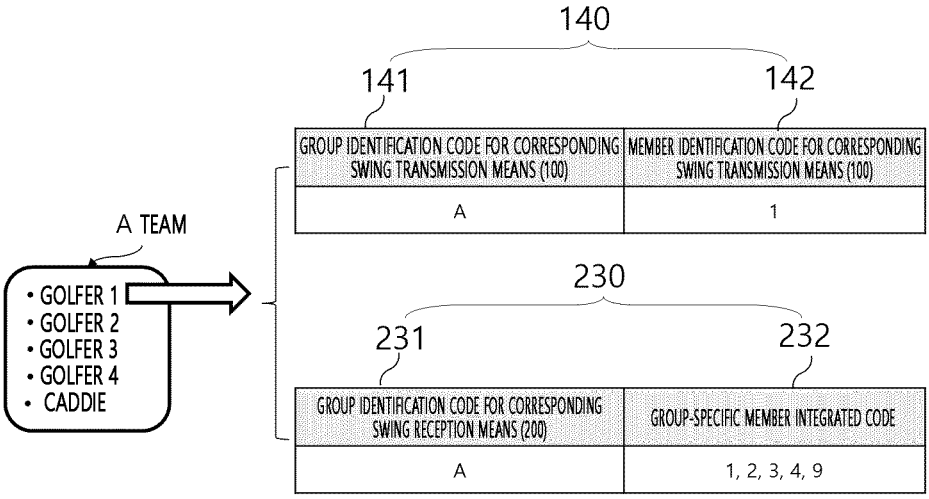

【FIG.15】
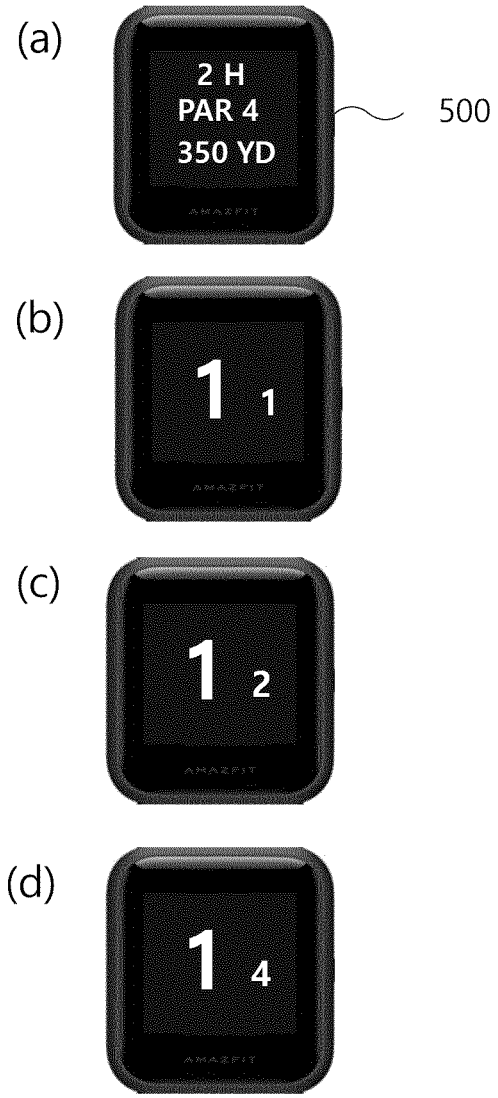

【FIG.16】
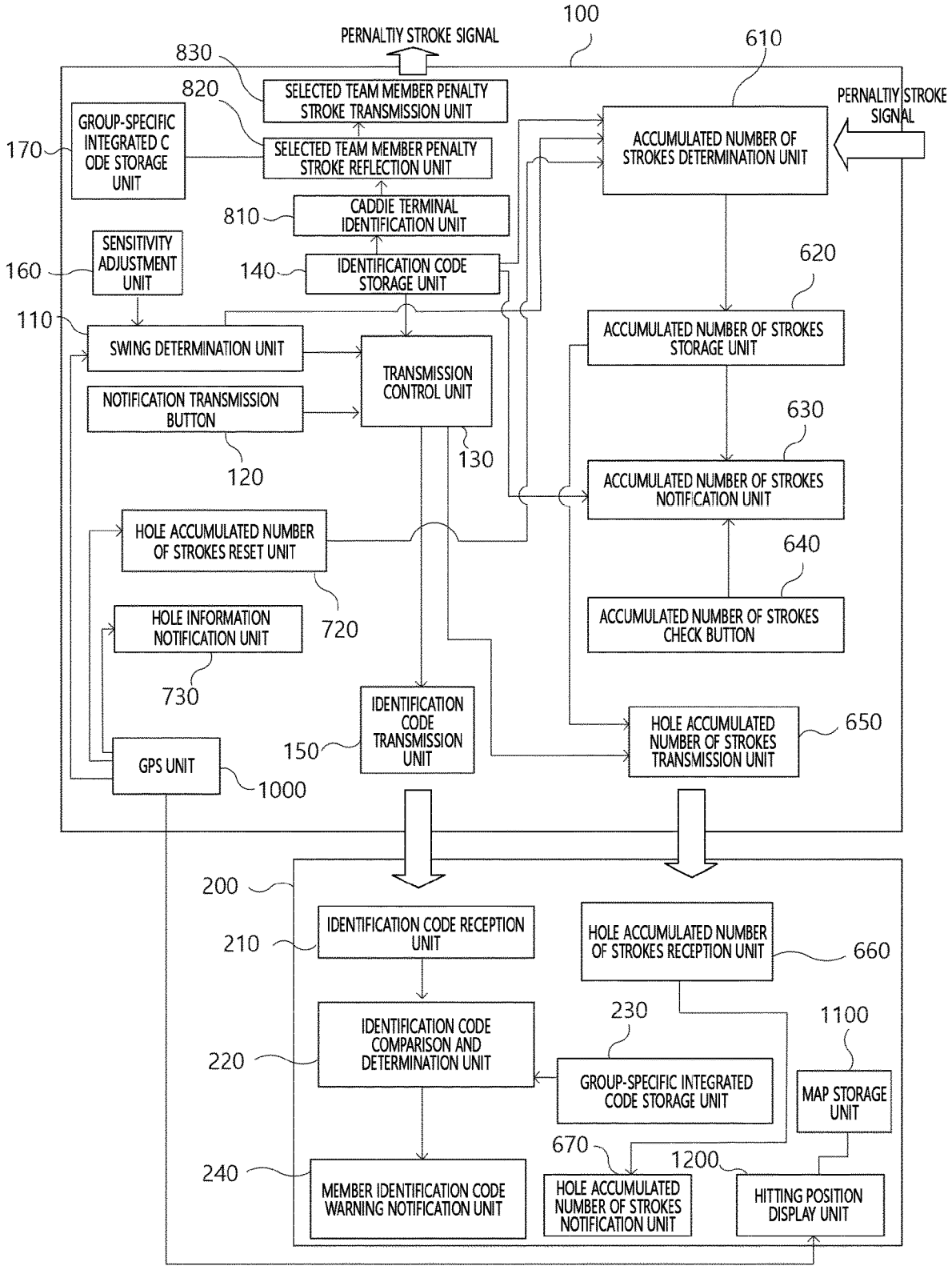

【FIG.17】
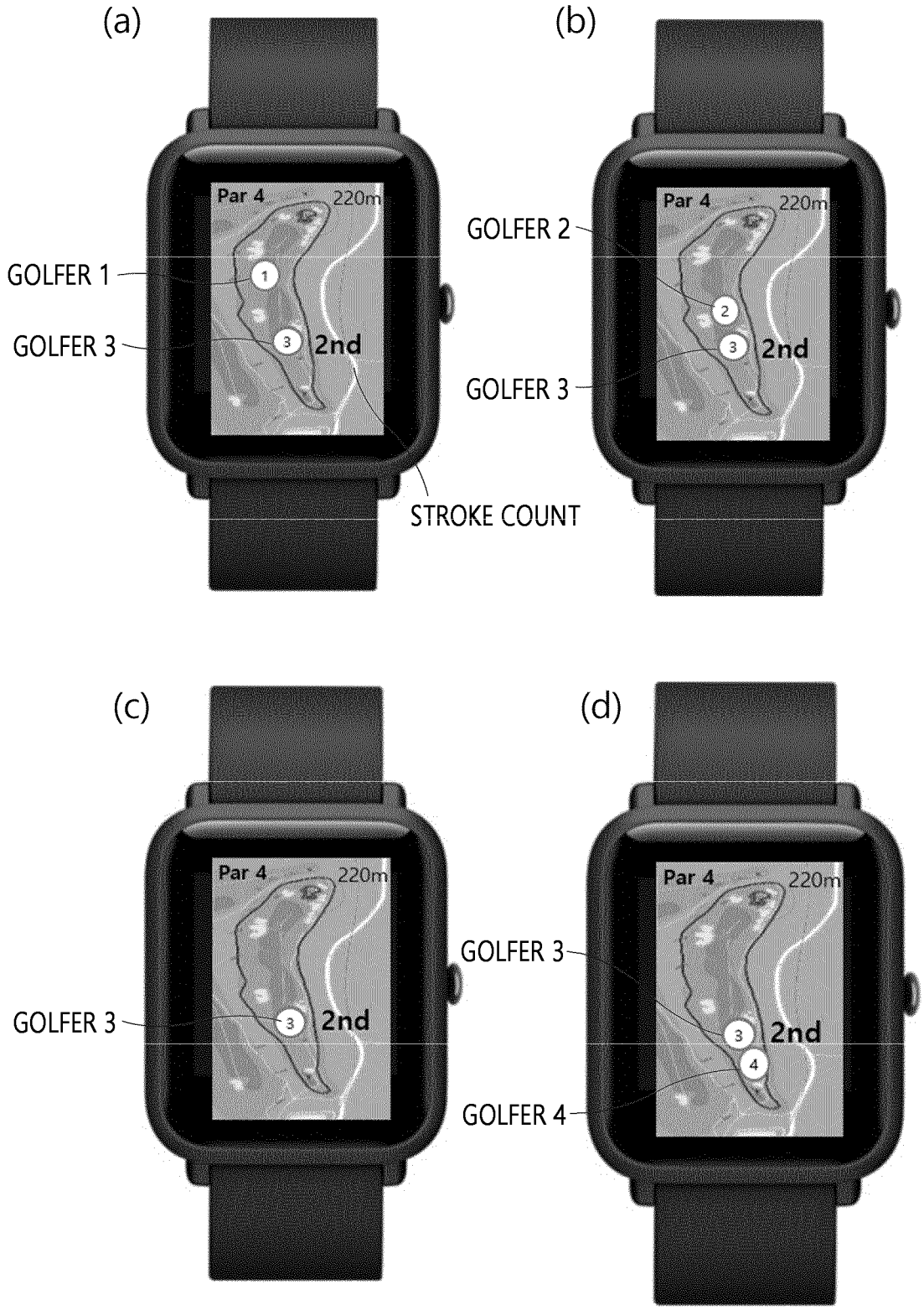

【FIG.18】
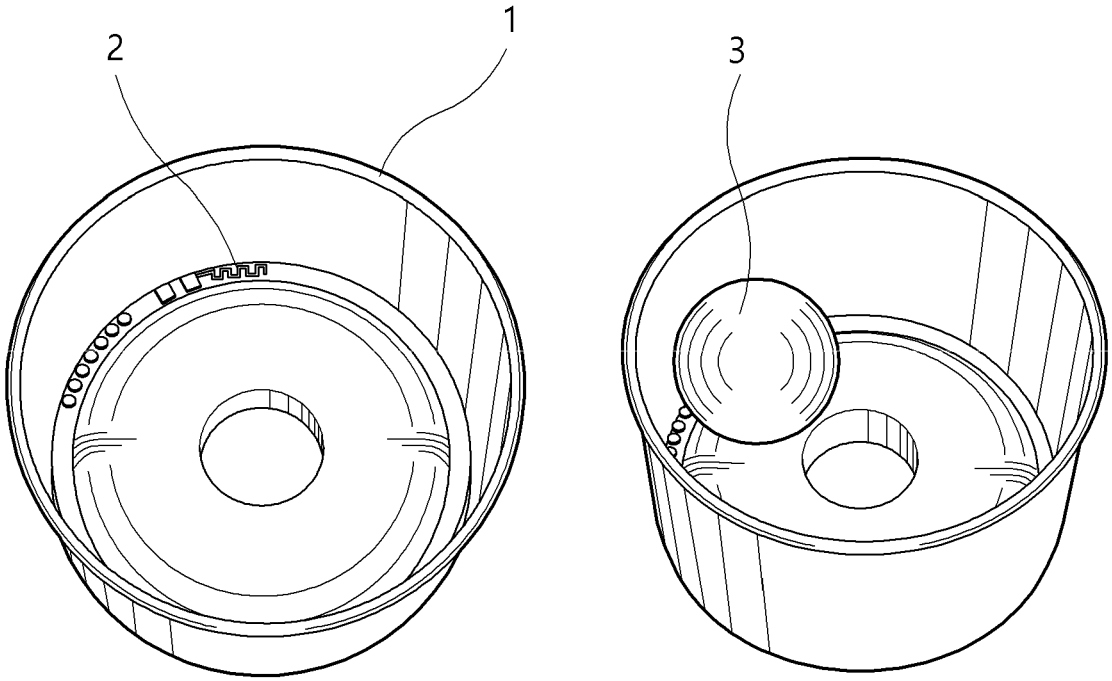

GOLF SWING NOTIFICATION DEVICE

TECHNICAL FIELD

The present invention relates to a golf swing notification device, and in particular, relates to a golf swing notification device capable of notifying a person who has made a golf swing and other team members of so-called "golf swing information" indicating that golf swing has been made by a fellow golfer, during a round of golf in a golf course.

Here, other team members refer to the remaining fellow golfers including the caddie within the same group.

The golf swing may be made through a hitting swing for actually striking the golf ball, or through a practice swing performed as a practice without hitting the golf ball prior to the hitting swing.

In addition, the present invention relates to a golf swing notification device capable of notifying a person who has made a golf swing and other team members of a 'hole accumulated number of strokes' and a 'total accumulated number of strokes' obtained based on the golf swing.

Here, the 'hole accumulated number of strokes' is a value calculated by accumulatively summing the golf swings made in the current hole, and the 'total accumulated number of strokes' is a value calculated by summing both the total hole accumulated number of strokes in the previous holes and the accumulated number of stokes in the current hole.

In addition, the present invention also relates to a golf swing notification device capable of displaying, to every team member, a position of a person who has made a golf swing together with positions of respective team members so that each of other team members is able to know where the position of the person who has made the golf swing is based on their position.

BACKGROUND ART

Golf is a sport that has been popular these days and is loved by many people, and in the present times, golf courses are crowded with many people from the morning. However, occasionally, news comes out about going into court lawsuits for being hit by a golf ball while playing golf.

There are people with long flight distances and people with short flight distances, and thus while playing golf, the people scatter on the field now ahead and now behind. At this time, there are cases where a golfer stands in front of a golfer behind who is about to hit the golf ball without realizing it, or does not pay attention to another golfer actually making the hitting swing while looking for the landed ball. In this situation, if the golfer behind hits the golf ball without attention, it is likely that a fellow golfer in front is exposed to the risk of being hit by the ball without knowing that the ball is flying.

Usually, in this case, the caddie alerts the rest of fellow golfers to the danger by shouting "ball", but the golf ball is already flying at the moment the caddie shouts "ball", and thus there is no way to avoid the risk of a fellow golfer in front being hit by the golf ball.

Meanwhile, when rounding one course, it is common for four golfers and one caddie to form a group as a team, and thus if the caddie focuses on one of the team members, the caddie may miss the moment other golfers making the hitting swing, and as a result, there may be a problem in that the caddie does not properly identify the customer's number of strokes in the golf game and the position where the golf ball has fallen.

Korean Patent No. 10-0926138 (Date: Nov. 10, 2009, hereinafter 'Document 1') discloses a 'golf swing information device' that issues notification of golf swing information by sensing the time required for each of steps of a golf swing by using a tilt sensor, a gyro sensor, or a wind pressure sensor.

However, Document 1 merely discloses that a golfer who has made the golf swing is notified of the golf swing information about the golfer, and is far from the technical spirit of the present invention capable of preventing other fellow golfers from being hit by the golf ball during a round of golf based on the golf swing information.

Korean Patent No. 10-1746662 (Date: Jun. 21, 2017, hereinafter 'Document 2') discloses a wearable type 'golf information providing device' worn on the wrist, by which game record factors such as the stroke count, the shot position, the flight distance, the swing trajectory for each shot, and the goal direction are automatically recorded without any separate manipulation of a golfer, and information such as hole information, the remaining distance, a recommended club, and the direction of the green is provided to the golfer.

However, in Document 2, feedback training or checking the stroke count may be possible, but Document 2 is also far from the technical spirit of the present invention for preventing other fellow golfers from being hit by the golf ball during a round of golf based on the golf swing information.

DISCLOSURE OF THE INVENTION

Technical Problem

Therefore, an object of the present invention is to provide a golf swing notification device capable of not only solving the above-described problems in the related art by notifying a person who has made a golf swing and other team members of so called 'golf swing information' indicating that a golf swing has been made by a fellow golfer during a round of golf, but also being very useful for the round of golf by further including an accumulated number of strokes notification and check function, a hole accumulated number of strokes reset function, a hole information notification function, a penalty stroke correction function, a hitting position display function, and a hole score notification function.

Technical Solution

In order to solve the problems, a golf swing notification device according to the present invention includes:

a swing transmission means and a swing reception means, which are provided as a set to each of team members in each group during a round of golf, the swing transmission means includes:

a swing determination unit determining whether or not a golf swing has been made and outputting a golf swing signal when the golf swing has been made;

an identification code storage unit storing a group identification code for identifying a group to which the swing transmission means belongs and a member identification code for identifying team members in the same group;

a transmission control unit outputting the group identification code and the member identification code stored in the identification code storage unit by using the golf swing signal as an input signal; and an identification code transmission unit receiving the group identification code and the member identification code output from the transmission control unit and transmitting the received codes to an outside, and the swing reception means includes:

an identification code reception unit receiving the group identification code and the member identification code transmitted from the identification code transmission unit;

a group-specific integrated code storage unit storing a group identification code for identifying a group to which the swing reception means belongs and a group-specific member integrated code that is a code for all team members in the same group;

an identification code comparison and determination unit comparing the group identification code received by the identification code reception unit with the group identification code stored in the group-specific integrated code storage unit, determining whether or not the member identification code received by the identification code reception unit is included in the group-specific member integrated code stored in the group-specific integrated code storage unit when it is determined that the group identification codes are the same, and outputting the member identification code when the determination result is affirmative; and a member identification code warning notification unit outputting a warning notification signal corresponding to the member identification code output from the identification code comparison and determination unit to the outside, and when any one of team members of a group has played a golf swing, not only the team member who has played the golf swing but also other team members in the group are notified that the golf swing has been made.

A notification transmission button may be installed in the swing transmission means to manually input the golf swing signal at the transmission control unit.

A sensitivity adjustment unit for adjusting sensitivity when the swing determination unit determines whether or not the golf swing has been made may be installed in the swing transmission means.

The golf swing may be made through a hitting swing for actually striking a golf ball, or through a practice swing performed as a practice without hitting the golf ball prior to a hitting swing.

Preferably, the swing determination unit receives and presets a reference time interval or a reference position range through an external input, and outputs the golf swing signal once even if a plurality of golf swings are made within the reference time interval or the reference position range.

The swing transmission means and the swing reception means may be separately mounted on separate two-piece bodies, or may be mounted together on a one-piece body.

The swing transmission means may further include:

an accumulated number of strokes determination unit determining a hole accumulated number of strokes by accumulatively summing golf swings made in a current hole and determining a total accumulated number of strokes by summing the hole accumulated number of strokes in a previous hole and the hole accumulated number of strokes in the current hole;

an accumulated number of strokes storage unit storing the hole accumulated number of strokes and the total accumulated number of strokes calculated by the accumulated number of strokes determination unit; and a hole accumulated number of strokes transmission unit receiving a command to transmit the hole accumulated number of strokes which is output from the transmission control unit using the golf swing signal as an input signal and transmitting the hole accumulated number of strokes stored in the accumulated number of strokes storage unit to the outside, and the swing reception means may include:

a hole accumulated number of strokes reception unit receiving the hole accumulated number of strokes transmitted from the hole accumulated number of strokes transmission unit; and a hole accumulated number of strokes notification unit outputting the hole accumulated number of strokes received by the hole accumulated number of strokes reception unit in association with the member identification code output from the identification code comparison and determination unit.

Preferably, a reference time interval or a reference position range is preset by input in the accumulated number of strokes determination unit through an external input, and the accumulated number of strokes determination unit determines the hole accumulated number of strokes by treating a plurality of golf swings as one golf swing even if the plurality of golf swings are made within the reference time interval or the reference position range.

The swing transmission means may further include:

an accumulated number of strokes notification unit giving notification of the hole accumulated number of strokes and the total accumulated number of strokes stored in the accumulated number of strokes storage unit to the outside; and an accumulated number of strokes check button for executing selective notification of the hole accumulated number of strokes and the total accumulated number of strokes through the accumulated number of strokes notification unit.

The golf swing notification device according to the present invention may further include:

a hole information terminal installed on a tee ground that is a starting location of each hole and transmitting, to the outside, a hole terminal signal for giving notification of existence of the hole information terminal, the swing transmission means may further include:

a hole information terminal recognition unit recognizing the hole information terminal signal; and a hole accumulated number of strokes reset unit outputting, to the accumulated number of strokes determination unit, a hole accumulated number of strokes reset signal for resetting the hole accumulated number of strokes to zero when the hole information terminal recognition unit recognizes the hole information terminal signal.

Preferably, the hole terminal signal includes hole information including a name, a number of par, and a distance between a tee ground and a hole cup that is an end point of the hole, and the accumulated number of strokes determination unit is installed to calculate the hole accumulated number of strokes by limiting a double value of the number of par obtained from the hole information to a maximum value when the hole information terminal signal is recognized by the hole information terminal recognition unit.

the swing transmission means may further include:

a selected team member penalty stroke reflection unit installed to select a team member to be given a penalty stroke and increase or decrease the number of penalty strokes to be given to the selected team member;

a caddie terminal identification unit having a reference value for caddie identification preset by input through an external input, and activating the selected team member penalty stroke reflection unit through recognition as the caddie terminal when the reference value for caddie identification matches the group identification code and the member identification code of the identification code storage unit; and a selected team member penalty stroke transmission unit transmitting a selected team member selected by the selected team member penalty stroke reflection unit and the number of penalty strokes for the team member, as a penalty stroke signal to the outside, and the accumulated number of strokes determination unit may be installed to check whether or not the selected team member transmitted by being included in the penalty stroke signal transmitted from the penalty stroke transmission unit is a team member corresponding to the group identification code and the member identification code of the identification code storage unit and then reflect the number of penalty strokes for the selected team member in the calculation of the hole accumulated number of strokes when it is determined that the check result is affirmative.

the swing transmission means may further include:

a GPS unit calculating GPS position coordinates and having basic position information including tee ground position coordinates input and preset; and an accumulated number of strokes reset unit recognizing that a golfer enters the tee ground through the tee ground position coordinates preset by input to the GPS unit based on the GPS position coordinates calculated by the GPUs unit, when the golfer enters the tee ground, and outputting, to the accumulated number of strokes determination unit, a hole accumulated number of strokes reset signal for resetting the hole accumulated number of strokes to zero.

Preferably, hole information including a name, a number of par, and a distance between a tee ground and a hole cup that is an end point of the hole is preset by input in the GPS unit, and the accumulated number of strokes determination unit is installed to calculate the hole accumulated number of strokes by limiting a double value of the number of par obtained from the hole information preset by input in the GPS unit to a maximum value when it is recognized that the golfer enters the tee ground through the GPS unit.

The swing transmission means may further include a GPS unit calculating GPS position coordinates, and the swing reception means may further include a map storage unit storing a golf course map and a hitting position display unit, the GPS unit may output, to the hitting position display unit, GPS position coordinates at which a golf swing signal is generated, when the swing determination unit outputs the golf swing signal, and the hitting position display unit may be installed to display a marker of the GPS position coordinates on the map.

In this case, preferably, the hitting position display unit is installed to display a warning notification signal of the member identification code warning notification unit and the hole accumulated number of strokes of the hole accumulated number of strokes notification unit, together with the marker of the GPS position coordinates.

In addition, preferably, the hitting position display unit is installed to display a marker of a position of a person who wears the swing transmission means and the swing reception means as a set, together with the marker of the GPS position coordinates on the map.

In the golf swing notification device according to the present invention, a hole cup sensor may be installed in the hole cup to detect that the golf ball is hole-in, a hole-in signal may be transmitted to the hole accumulated number of strokes notification unit through the hole cup sensor when the golf ball is holed into the hole cup through an approach shot or a putting shot of a golfer, and the hole accumulated number of strokes notification unit that has received the hole-in signal from the hole accumulated number of strokes notification unit may be installed to recognize that rounding in the hole is over for the golfer and notify all team members including the golfer of a hole score of the golfer at the hole.

Advantageous Effects

According to the present invention, first, since the caddie and other fellow golfers are able to know in advance that the golf swing has been made by a fellow golfer, it is possible to be careful not to be hit by the golf ball (hit warning notification function) in advance, second, from the standpoint of the caddie, it is possible to observe the moment of the hitting swing and the trajectory of the ball, and thus to accurately identify the location where the golf ball falls and the number of strokes in the golf game and notify customers of what has been identified, and third, since the golf swing information also reaches the person who has made the golf swing, it is possible for the person who has made the golf swing to directly check whether the golf swing notification device according to the present invention operates properly through whether or not the golf swing information has reached the person, and take action.

The golf swing may be made through a hitting swing for actually striking the golf ball, or through a practice swing performed as a practice without hitting the golf ball prior to the hitting swing.

When performing a practice swing, the golf swing will be made through the practice swing in advance, and thus the other fellow golfers may have enough time to dodge the golf ball while watching the subsequent hitting swing.

If the hitting swing is made right away without the practice swing, the golf swing would be only made during the hitting swing, and thus the golf ball would fly right after the golf swing, and the other fellow golfers may have less time to dodge the golf ball than the aforementioned case.

In general, since it is common to make a practice swing before the hitting swing for better hitting, it can be said that, when there is the practice swing, the effectiveness of the hit warning notification function according to the present invention is higher.

In particular, the present invention is very useful in that it has an accumulated number of strokes notification and check function that enables a golfer and other fellow golfers to be notified of stroke count at all times during a round of golf, and also has a hole accumulated number of strokes reset function, a hole information notification function, a penalty stroke correction function, and the like.

Meanwhile, from the standpoint of each of team members, since the hit warning notification function would be more useful when the position of the person who has made the golf swing is behind the other team members than when the person who has made the golf swing is in front of the other team members, and thus it is important to know where the person who has made the golf swing is positioned relative to the position of each team member. According to the present invention, team members' own positions and the position of the person who has made the golf swing are displayed to each of the team members together, and thus each team member is able to know which side the person who has made the golf swing is positioned based on the team member.

BRIEF DESCRIPTION OF THE DRAWINGS

FIG. 1 is a block diagram illustrating a golf swing notification device according to a first embodiment of the present invention;

FIG. 2 is a block diagram illustrating an identification code storage unit 140 of FIG. 1;

FIG. 3 is a block diagram illustrating a group-specific integrated code storage unit 230 of FIG. 1;

FIG. 4 is a diagram illustrating an operating principle of FIG. 1;

FIG. 5 is a view illustrating a two-piece type golf swing notification device according to FIG. 1;

FIG. 6 is a view illustrating a one-piece type golf swing notification device according to FIG. 1;

FIG. 7 is a block diagram illustrating a golf swing notification device according to a second embodiment of the present invention;

FIG. 8 is a diagram illustrating an accumulated number of strokes determination unit 610 of FIG. 7;

FIG. 9 is a diagram illustrating an accumulated number of strokes storage unit 620 of FIG. 7;

FIG. 10 is a diagram illustrating an accumulated number of strokes notification unit 630 of FIG. 7;

FIG. 11 is a diagram illustrating an accumulated number of strokes check button 640 of FIG. 7;

FIG. 12 is a diagram illustrating a selected team member penalty stroke reflection unit 820 of FIG. 7;

FIG. 13 is a diagram illustrating a group-specific integrated code storage unit 232 of FIG. 7;

FIGS. 14 and 15 are diagrams illustrating an operating principle of FIG. 7;

FIG. 16 is a block diagram illustrating a golf swing notification device according to a third embodiment of the present invention;

FIG. 17 is a view illustrating a hitting position display function using GPS; and FIG. 18 is a view illustrating a hole cup sensor 2.

REFERENCE SIGNS LIST

100: Swing transmission means
110: Swing determination unit 120: Notification transmission button
130: Transmission control unit 140: Identification code storage unit
141: Group identification code for corresponding swing transmission means 100
142: Member identification code for corresponding swing transmission means 100
150: Identification code transmission unit 160: sensitivity adjustment unit
170: Group-specific integrated code storage unit
171: Group identification code 172: Group-specific member integrated code
200: Swing reception means
210: Identification code reception unit 220: Identification code comparison and determination unit
230: Group-specific integrated code storage unit
231: Group identification code for corresponding swing reception means 230
232: Group-specific member integrated code 240: Member identification code warning notification unit
300: Receiving terminal 400: Transmitting terminal
500: Transmitting and receiving terminal
610: Accumulated number of strokes determination unit 611: Hole accumulated number of strokes determination unit
612: Total accumulated number of strokes determination unit 620: Accumulated number of strokes storage unit
621: Hole accumulated number of strokes storage unit 622: Total accumulated number of strokes storage unit
630: Accumulated number of strokes notification unit 631: Hole accumulated number of strokes notification unit
632: Total accumulated number of strokes notification unit 640: Accumulated number of strokes check button
641: Hole accumulated number of strokes check button 642: Total accumulated number of strokes check button
650: Hole accumulated number of strokes transmission unit 660: Hole accumulated number of strokes reception unit
670: Hole accumulated number of strokes notification unit 700: Hole information terminal
710: Hole information terminal recognition unit 720: Hole accumulated number of strokes reset unit
730: Hole information notification unit 810: Caddie terminal identification unit
820: Selected team member penalty stroke reflection unit 821: Team member selection unit
822: Penalty increase and decrease unit 830: Selected team member penalty stroke transmission unit
1000: GPS unit 1100: Map storage unit
1200: Hitting position display unit

MODE FOR CARRYING OUT THE INVENTION

Hereinafter, preferred embodiments of the present invention will be described in detail with reference to the accompanying drawings. The following embodiments are only presented to understand the content of the present invention, and those of ordinary skill in the art could make numerous alternations within the technical spirit of the present invention. Therefore, the scope of the present invention should not be construed as being limited to these embodiments.

[First Embodiment] Hit Warning Notification Function

FIG. 1 is a block diagram illustrating a golf swing notification device according to a first embodiment of the present invention. Referring to FIG. 1, the golf swing notification device according to the present invention includes a swing transmission means 100 and a swing reception means 200.

Swing Transmission Means 100

The swing transmission means 100 includes a swing determination unit 110, a notification transmission button 120, a transmission control unit 130, an identification code storage unit 140, an identification code transmission unit 150, and a sensitivity adjustment unit 160.

The swing determination unit 110 determines whether or not a golf swing has been made and outputs a golf swing signal when the golf swing has been made. The swing determination unit 110 is for determining whether a golf swing has been made, and may include various things such as an acceleration sensor, a gyroscope, a trajectory sensor (acceleration sensor plus gyroscope), and an artificial intelligence motion analysis program.

Since the golf swing is made by raising the arms and hitting it with a strong force, the swing may be detected by using various sensors for detecting various movements.

When an acceleration sensor is used, it is preferable to use two or more axes, for example, a three-axis acceleration sensor. This may make suppressed the possibility of erroneously determining that the normal movement of the arm while walking is also a golf swing, since the curvature of the movement of the arm may be determined by using two or more axes to measure the change in acceleration in each of the axes, such as the X-axis parallel to the ground and the Y-axis perpendicular to the ground, and the movement when the curvature is within a certain range may be determined as the golf swing.

Preferably, the swing determination unit 110 receives and presets a reference time interval or a reference position range through an external input, and outputs only one golf swing signal for the first golf swing, even if a plurality of golf swings are made within the reference time interval or the reference position range.

For example, there is a case in which the reference time interval is set to one minute and the hitting swing is made after two practice swings within one minute, which means that only the first practice swing is regarded as a golf swing, and there is another case in which the reference position range is set to two meters and the hitting swing is made after two practice swings within range of two meters, which means that only the first practice swing is regarded as a golf swing.

As shown in FIG. 2, in the identification code storage unit 140, a group identification code 141 and a member identification code 142 for the corresponding swing transmission means 100 are stored in advance. The group identification code 141 refers to a code for identifying a group to which the swing transmission means 100 belongs, and the member identification code 142 is a subcategory of the group identification code 141 and refers to a code for identifying team members in the same group.

When the swing determination unit 110 outputs the golf swing signal, the transmission control unit 130 retrieves the group identification code 141 and the member identification code 142 stored in the identification code storage unit 140 by using the golf swing signal as an input signal, and sends, to the identification code transmission unit 150, a command to transmit the above identification codes to the outside. Then, the identification code transmission unit 150 transmits, to the swing reception means 200, the group identification code 141 and the member identification code 142 for the swing transmission means 100 as golf swing information.

In the case of an approach shot, the swing is made with very small and simple movement, and thus the swing determination unit 110 may not be able to determine the shot as a golf swing. In this case, it is preferable to manually output the golf swing signal to the transmission control unit 130 through the manipulation of the notification transmission button 120 inevitably.

If the swing determination unit 110 does not properly distinguish between a general motion such as walking or holding a hat and a golf swing motion, the effectiveness thereof will be reduced. Of course, this problem may be overcome to some extent by using the notification transmission button 120; however, in order to increase the effectiveness of the swing determination unit 110, it is preferable to provide the sensitivity adjustment unit 160 for adjusting sensitivity of the swing determination unit 110 so that the sensitivity of the between the general motion and the golf swing may be adjusted depending on the situation.

Swing Reception Means 200

The swing reception means 200 includes an identification code reception unit 210, an identification code comparison and determination unit 220, a group-specific integrated code storage unit 230, and a member identification code warning notification unit 240.

The identification code reception unit 210 receives information when the information is transmitted from the identification code transmission unit 150 while being always on standby in a receivable state, and then parses and separates the information, acquires the group identification code 141 and the member identification code 142 for the swing transmission means 100 through the separated information, and transmits the acquired identification codes to the comparison and determination unit 220.

When playing golf, the group members may be separated from each other by approximately 150 to 200 m while going now ahead and now behind, and thus it is preferable to use a method in which transmission from the identification code transmission unit 150 to the identification code reception unit 210 is performed at a distance as far as possible. For example, it is preferable to use an improvement of communication distance and quality such as Bluetooth 5.0 or higher or Wi-Fi 6, which is a next-generation wireless LAN communication standard.

As shown in FIG. 3, in the group-specific integrated code storage unit 230, a group identification code 231 and a group-specific member integrated code 232 for the swing reception means 200 are stored in advance. The group identification code 231 refers to a code for identifying a group to which the swing reception means 200 belongs, and the group-specific member integrated code 232 is a subcategory of the group identification code 231 and refers to a code for all team members in the same group.

The identification code comparison and determination unit 220 compares the group identification code 141 transmitted from the identification code reception unit 210 with the group identification code 231 stored in the group-specific integrated code storage unit 230, determines whether the member identification code 142 transmitted from the identification code reception unit 210 is included in the group-specific member integrated code 232 stored in the group-specific integrated code storage unit 230 when it is determined that the group identification code 141 and the group identification code 231 are the same, and transmits the member identification code 142 to the member identification code warning notification unit 240 when the determination result is affirmative.

The member identification code warning notification unit 240 outputs a warning notification signal corresponding to the member identification code 142 to the outside. For example, when trying to notify by sound, the sound notification may be performed by making a "beep" sound once when the member identification code 142 is '1', the "beep" sound twice when the member identification code 142 is '2', and the "beep" sound three times when the member identification code 142 is '3', and in this way, the notification of which golfer has made the golf swing may be achieved. It is also a preferable to process the sound notification into voices such as "golfer 1," "golfer 2," "golfer 3," and "golfer 4" by using a voice chip. Furthermore, in the case of displaying in liquid crystal through OLED, it is preferable to display the identification code 142 largely on the liquid crystal and produce vibration.

1. Two-Piece Type

The two-piece type refers to a case where a transmitting terminal 400 and a receiving terminal 300 have independent bodies. In this case, the swing transmission means 100 will be mounted on the transmitting terminal 400, and the swing reception means 200 will be mounted on the receiving terminal 300, respectively.

Since the transmitting terminal 400 needs to recognize the golf swing, it is preferable to provide it in the type of a wrist watch worn on the wrist or in a golf glove attachment type. In FIG. 5*a*, the golf glove attachment type is illustrated as an example.

When using the sound notification, the receiving terminal 300 is preferably provided in a ball marker type as illustrated in FIG. 5*b*. This is because when a ball marker indicating the position of a ball in a golf course is generally attached to a hat, which is close to the ear, for use, the sound notification can be heard well.

2. One-Piece Type

The one-piece type refers to a case where the swing transmission means 100 and the swing reception means 200 are mounted on a single body called a transmitting and receiving terminal 500.

In this case, it is preferable that the transmitting and receiving terminal 500 is provided in a wrist watch type or a golf glove attachment type so that the golf swing may be checked through a time notification (e.g., number). In FIG. 6, as an example of the transmitting and receiving terminal 500, a wrist watch type is illustrated as an example.

<Operating Principle>

FIG. 4 is a diagram illustrating an operation principle of FIG. 1, and it is assumed that team A and team B play golf on the same hole, and in this case, each team has 4 golfers and 1 caddie as a team member.

Every team member in team A and team B wears the swing transmission means 100 and the swing reception means 200. For example, golfer 1 of group A also wears the swing transmission means 100 and the swing reception means 200 together, and the same is true for the caddie of group B.

At this time, in the identification code storage unit 140 of the swing transmission means 100 worn by golfer 1 of the group A, 'A' is input as the group identification code 141 for identifying the group to which the corresponding swing transmission means 100 belongs, and '1' is inputted as the member identification code 142 for identifying the member having the corresponding swing transmission means 100.

In addition, in the group-specific integrated code storage unit 230 of the swing reception means 200 worn by golfer 1 of the group A, 'A' is input as the group identification code 231 for identifying the group to which the corresponding swing reception means 200 belongs, and '1', '2', '3', '4', and '5' are inputted as the group-specific member integrated code 232 for displaying all members of group A.

When golfer 1 of group A makes a golf swing, the swing determination unit 110 outputs a corresponding golf swing signal to the transmission control unit 130, the transmission control unit 130 retrieves the group identification code 141 and the member identification code 142 stored in the identification code storage unit 140 by using the golf swing signal as an input signal, and sends, to the identification code transmission unit 150, a command to transmit, to the outside, the above identification codes as golf swing information. Then, the identification code transmission unit 150 transmits, to the swing reception means 200, 'A' as the group identification code 141 and '1' as the member identification code 142.

Golfer 1, golfer 2, golfer 3, golfer 4, the caddie of group A and golfer 1, golfer 2, golfer 3, golfer 4, and the caddie of group B obtain 'A' and '1' through their respective swing reception means 200, and at this time, a warning notification signal is not output from the swing reception means 200 in group B, and a warning notification signal corresponding to '1', for example, a sound notification of "beep" or "golfer 1" is output only from the swing reception means 200 in the same group A to the outside.

Since group A and group B play rounds with a time difference, they have a considerable distance from each other, and thus it is not preferable to generate a warning notification signal to group B due to the golf swing made in group A. Usually in a golf course, 30 to 80 groups play rounds a day, and thus it is very important to determine whether the group identification code 141 matches. This is because when the signal of another group is recognized as being of the same group, a warning notification signal of the other team is also generated, increasing confusion during the round of golf.

Due to the above operating principle, the remaining fellow golfers of group A (golfer 2, golfer 2, and golfer 4) may recognize that golfer 1 in the same group has made the golf swing and be careful not to be hit by the golf ball in advance.

Golfer 1, who has made the golf swing, may confirm that the golf swing notification device according to the present invention is operating properly by listening to the warning notification signal by themselves, and if the warning notification signal is not heard, golfer 1 may take action to solve it by using the sensitivity adjustment unit 160 or notification transmit button 120.

In addition, since the caddie of group A may recognize that the golf swing has been made, the caddie may properly grasp the landing position of the golf ball and the number of golf strokes by watching the moment of the hitting swing and the trajectory of the ball flying.

Furthermore, there may be a situation where other fellow golfers watch the hitting swing of golfer 1 from a distance for a while and shout "good shot" that golfer 1 has hit the ball well, which may make the round of golf a fun time to be considerate of each other.

[Second Embodiment] Number of Strokes Notification Function

FIG. 7 is a block diagram illustrating a golf swing notification device according to a second embodiment of the present invention, showing a case in which an accumulated number of strokes notification and check function, a hole accumulated number of strokes reset function, a hole information notification function, and a penalty stroke correction function are further added to the golf swing notification device illustrated in FIG. 1.

Accumulated Number of Strokes Notification and Check Function

For the accumulated number of strokes notification function, the golf swing notification device according to the present invention includes an accumulated number of strokes determination unit 610, an accumulated number of strokes storage unit 620, an accumulated number of strokes notification unit 630, and an accumulated number of strokes check button 640, and a hole accumulated number of strokes transmission unit 650 in the swing transmission means 100, and includes a hole accumulated number of strokes reception unit 660 and a hole accumulated number of strokes notification unit 670 in the swing reception means 200.

As illustrated in FIG. 8, the accumulated number of strokes determination unit 610 includes a hole accumulated number of strokes determination unit 611 and a total accumulated number of strokes determination unit 612.

Here, the 'hole accumulated number of strokes' is a value calculated by accumulatively summing the golf swings made in the current hole, and the 'total accumulated number of strokes' is a value calculated by summing both the total hole accumulated number of strokes in the previous holes and the number of stokes in the current hole.

For example, when it is assumed that the full round consists of 18 holes and the game is currently being played in hole 2, the 'hole accumulated number of strokes' means the accumulated number of strokes of the golf swing made in hole 2, and 'the total accumulated number of strokes' means the sum of the accumulated number of strokes of the golf swing made in hole 1 and the accumulated number of strokes of the golf swing made in hole 2.

The hole accumulated number of strokes determination unit 611 calculates the hole accumulated number of strokes by using the golf swing signal output from the swing determination unit 110 as an input signal. At this time, since the golf swing signal may be output from the swing determination unit 110 for the practice swing as well as the actual striking swing, correction is required in order to reflect only the number of strokes for the actual hitting swing.

As one method for correction, a reference time interval or a reference position range is preset by input in the hole accumulated number of strokes determination unit 611 through an external input, and the hole accumulated number of strokes determination unit 611 treats a plurality of golf swing signals as one golf swing even if the plurality of golf swing signals are input within the reference time interval or the reference position range and accumulatively sums the golf swings.

In this case, a method is particularly preferable in which, among the golf swings made within the reference time interval or the reference position range, only the first golf swing is reflected in the accumulative sum and the golf swings made within the reference time interval or the reference position range after the first golf swing are not reflected in the accumulative sum.

Through the correction, even if the practice swing is made before the hitting swing, the accumulated number of strokes calculated by the hole accumulated number of strokes determination unit 611 is practically no different from the accumulated number of strokes for the hitting swing.

Of course, as described above, when the swing determination unit 110 receives and presets the reference time interval or the reference position range through an external input, and outputs only one golf swing signal for the first golf swing, even if a plurality of golf swings are made within the reference time interval or the reference position range, it may not be necessary to perform the correction as above in the hole accumulated number of strokes determination unit 611.

As illustrated in FIG. 9, the accumulated number of strokes storage unit 620 includes a hole accumulated number of strokes storage unit 621 for storing the hole accumulated number of strokes calculated by the accumulated number of strokes determination unit 610, and a total accumulated number of strokes storage unit 622 for storing the total accumulated number of strokes calculated by the accumulated number of strokes determination unit 610.

As illustrated in FIG. 10, the accumulated number of strokes notification unit 630 includes a hole accumulated number of strokes notification unit 631 for issuing notification of the hole accumulated number of strokes stored in the hole accumulated number of strokes storage unit 621 to the outside, and a total accumulated number of strokes notification unit 632 for issuing notification of the total accumulated number of strokes stored in the total accumulated number of strokes storage unit 622 to the outside.

As illustrated in FIG. 11, the accumulated number of strokes check button 640 includes a hole accumulated number of strokes check button 641 for operating the hole accumulated number of strokes notification unit 631 and a total accumulated number of strokes check button 642 for operating the total accumulated number of strokes notification unit 632.

As described above, the transmission control unit 130 retrieves the group identification code 141 and the member identification code 142 stored in the identification code storage unit 140 by using the golf swing signal as an input signal, and sends, to the identification code transmission unit 150, a command to transmit the above identification codes to the outside. At this time, the command to transmit the hole accumulated number of strokes is also output to the hole accumulated number of strokes transmission unit 650.

The hole accumulated number of strokes transmission unit 650 receives the command to transmit the hole accumulated number of strokes, which is output from the transmission control unit 130, and transmits, to the outside, the hole accumulated number of strokes stored in the hole accumulated number of strokes storage unit 651.

The hole accumulated number of strokes reception unit 660 receives the hole accumulated number of strokes transmitted from the hole accumulated number of strokes transmission unit 650, and the hole accumulated number of strokes notification unit 670 issues notification of the hole accumulated number of strokes received by the hole accumulated number of strokes reception unit 660 to the outside.

When the golf swing signal is output from the swing determination unit 110, a notification signal corresponding to the member identification code is output to the outside through the member identification code notification unit 240 as described in FIG. 1. Accordingly, when the notification of the hole accumulated number of strokes is issued to the outside through the hole accumulated number of strokes notification unit 670, a notification signal corresponding to the member identification code is also output to the outside through the member identification code notification unit 240.

Hole Accumulated Number of Strokes Reset Function

Since the hole accumulated number of strokes is reset when moving over to the next hole in the round, that is, at the start in the new hole and has to be accumulatively summed again from the zero state, it is preferable to provide a hole accumulated number of strokes reset function to this end.

To this end, it is preferable that the present invention includes a hole information terminal 700 installed at the tee ground, which is a starting position for each hole, separate from the swing transmission means 100 and the swing reception means 200, and a hole information terminal recognition unit 710 and a hole accumulated number of strokes reset unit 720 in the swing transmission means 100.

The hole information terminal 700 outputs a hole terminal signal indicating the existence of the hole terminal. In this case, the hole terminal signal may include hole information on a corresponding hole, for example, a name, a number of par, a distance between a tee ground and a hole cup, which is an end point, of the hole.

When the hole information terminal recognition unit 710 receives the hole terminal signal, the hole accumulated number of strokes reset unit 720 outputs a hole accumulated number of strokes reset signal. The hole accumulated number of strokes determination unit 611 receives the hole accumulated number of strokes reset signal and resets the hole accumulated number of strokes to zero.

Therefore, whenever moving over to the next hole in the round, the hole accumulated number of strokes is automatically accumulated and summed from zero from the start at the new hole.

Hole Information Notification Function

When the hole information terminal recognition unit 710 receives the hole terminal signal, a hole information notification unit 730 issues notification of the hole information included in the hole terminal signal to the outside. The hole information may include the name, a number of par, and the distance between the tee ground and the hole cup, which is the end point, of the hole.

Meanwhile, when calculating the hole accumulated number of strokes in a golf game, the maximum number of strokes per hole is generally set to twice the number of par assigned to each hole as a maximum value. For example, even if a golfer hits more than 8 strokes in a par 4 hole, only 8 strokes are counted. This situation is called Double PAR in golf.

The hole information notification function also contributes to reflecting this point. To this end, the hole accumulated number of strokes determination unit 611 calculates the hole accumulated number of strokes with the double of the number of par of the hole recognized by the hole information terminal recognition unit 710 being limited to the maximum number.

Penalty Stroke Correction Function

In golf, there are rules that penalty strokes are incurred in various cases, such as a golf ball hitting out of bounds or falling into a hazard. Therefore, it is necessary to reflect the penalty stroke.

In the present invention, for the caddie to perform the penalty stroke correction function, the swing transmission means 100 may include a group-specific integrated code storage unit 170, a caddie terminal identification unit 810, a selected team member penalty stroke reflection unit 820, and a selected team member penalty stroke transmission unit 830.

In the caddie terminal identification unit 810, 'a reference value for caddie check' is preset by input through an external input, and when the group identification code 141 and the member identification code 142, which are stored in the identification code storage unit 140 of the swing transmission means 100, match the reference value for caddie check, the selected team member penalty stroke reflection unit is recognized as the caddie terminal.

As illustrated in FIG. 12, the selected team member penalty stroke reflection unit 820 includes a team member selection unit 821 and a penalty stroke increase and decrease unit 822, and when recognized as the caddie terminal through the caddie terminal identification unit 810, the selected team member penalty stroke reflection unit is activated so that the caddie may operate it.

When the selected team member penalty stroke reflection unit 820 is activated, the caddie may select a team member to grant a penalty stroke through the team member selection unit 821, and may also increase or decrease the number of penalty strokes as desired through the penalty stroke increase and decrease unit 822.

The team member selection unit 821 utilizes the codes stored in the group-specific integrated code storage unit 170 so that members may be selected through the team member selection unit 821. As illustrated in FIG. 13, in the group-specific integrated code storage unit 170, a group identification code 171 and a group-specific member integrated code 172 for the corresponding swing transmission means 100 are stored.

In the present invention, since the swing transmission means 100 and the swing reception means 200 will be implemented as one set, the contents stored in the group-specific integrated code storage unit 170 of the swing transmission means 100 and the group-specific integrated code storage unit 230 of the swing reception means 200 would be substantially the same.

Therefore, in the case of the one-piece type where the swing transmission means 100 and the swing reception means 200 are implemented in one body, the group-specific integrated code storage unit 230 of the swing reception means 200 may be utilized without the need to separately install the group-specific integrated code storage unit 170 in the swing transmission means 100.

The selected team member penalty stroke transmission unit 830 transmits, to the outside, a penalty stroke signal including the team member selected by the selected team member penalty stroke reflection unit 820 and the number of penalty strokes for the team member.

The hole accumulated number of strokes determination unit 611 that has received the penalty stroke signal checks whether or not the selected team member transmitted by being included in the penalty stroke signal is a team member corresponding to the group identification code 141 and the member identification code 142 of the identification code storage unit 140 and then reflects the number of penalty strokes for the selected team member in the accumulative calculation of the hole accumulated number of strokes when it is determined that the check result is affirmative.

Meanwhile, in the case of an approach shot or a putting shot on the green in particular, the swing is performed with very small and simple movement, and thus the swing determination unit 110 may not be able to determine the shot as a golf swing and reflect it in the hole accumulated number of strokes. In this case, if the penalty stroke correction function is used, there is an advantage in that an approach shot or a putting shot may be reflected in the hole accumulated number of strokes.

<Operating Principle>

FIGS. 14 and 15 are diagrams illustrating an operating principle of FIG. 7. Description will be given assuming that team A, consisting of four golfers and one caddie, finishes playing golf on a first hole of par-5 and moves the round to a second hole of par 4. At this time, the hole accumulated number of strokes for each golfer in the first hole is six strokes for golfer 1, and seven strokes for the remaining golfer 2, golfer 3, and golfer 4. Further, all team members wear the transmitting and receiving terminal 500 in the form of a wrist watch as illustrated in FIG. 6.

Hole Accumulated Number of Strokes Reset and Hole Information Notification Operations When team A arrives at the tee ground, which is the starting position of the second hole, the hole information terminal recognition unit 710 of every team member recognizes the hole information terminal 700 installed in the tee ground. Then, the hole accumulated number of strokes reset unit 720 and the hole accumulated number of strokes determination unit 611 operate, and the hole accumulated number of strokes calculated in the first hole is reset to zero for all team members. At this time, hole information on the second hole is known to all team members through the hole information notification unit 730 as illustrated in FIG. 15*a*.

Golf Swing and Accumulated Number of Strokes Operations

Now, when golfer 1 enters a hitting plate and makes a large practice swing prior to the actual hitting swing, this is regarded as a golf swing, and through the member identification code notification unit 340 and the hole accumulated number of strokes notification unit 670, the meaning of 'golfer 1' and the meaning of 'hole accumulated number of strokes being 1' are known to all team members as illustrated in FIG. 15*b*. At this time, the accumulated number of strokes determination unit 610 determines that the hole accumulated number of strokes is 1 and the total accumulated number of strokes is 7, and determined numbers are stored in the accumulated number of strokes storage unit 620.

Then, when the actual hitting swing is made within the reference time interval, for example, within one minute, which is preset by input in the hole accumulated number of strokes determination unit 611, this will also be regarded as a golf swing, but the first golf swing has already been accumulated, and thus the hole accumulated number of strokes and the total accumulated number of strokes remain unchanged. In addition, team members are not repeatedly notified of the accumulated number of strokes.

Now, when golfer 1 moves to the location where the ball has fallen and performs the same action as above in the second hitting plate, as in the first hitting plate, through the member identification code notification unit 340 and the hole accumulated number of strokes notification unit 670, the meaning of 'golfer 1' and the meaning of 'hole accumulated number of strokes being 2' are known to all team members as illustrated in FIG. 15*c*. At this time, the accumulated number of strokes determination unit 610 determines that the hole accumulated number of strokes is 2 and the total accumulated number of strokes is 8, and determined numbers are stored in the accumulated number of strokes storage unit 620.

Then, when golfer 1 wants to check the number of strokes again while waiting for strokes of other golfers, golfer 1 presses the hole accumulated number of strokes check button 641 on his or her transmitting and receiving terminal 500. In this case, the same content as in FIG. 15*c* are output to the transmitting and receiving terminal 500 of golfer 1, and at this time, the output is not necessarily made to the transmitting and receiving terminal 500 of another team member. If a team member wants to check the total accumulated number of strokes, the team member may press the total accumulated number of strokes check button 642.

Penalty Stroke Correction Operation

When golfer 1 needs to be penalized because the ball struck by the golfer 1 at the second ball hitting hits out of bounds or falls into a hazard, penalty stroke correction may be made by the caddie.

When A and 9 as reference values for caddie check are preset for the transmitting and receiving terminals 500 of all team members by input in the caddie terminal identification unit 810, only the transmitting and reception terminal 500 in which the group identification code 141 and the member identification code 142 of the identification code storage unit 140 are A and 9, respectively, is regarded as the caddie terminal and the selected team member penalty stroke reflection unit 820 is activated.

When 2 penalty strokes are reflected for golfer 1 by the selected team member penalty stroke reflection unit 820 of the caddie terminal, the penalty stroke signal is transmitted to the transmitting and receiving terminals 500 of all team members through the selected team member penalty stroke transmission unit 830 of the caddie terminal.

The hole accumulated number of strokes determination unit 611 provided in the transmitting and receiving terminal 500 of all team members checks whether or not golfer 1 as the selected team member transmitted by being included in the penalty stroke signal is a team member corresponding to the group identification code 141 and the member identification code 142 stored in the identification code storage unit 140 and then reflects the number of penalty strokes for the corresponding team member in the accumulative calculation of the hole accumulated number of strokes when it is determined that the check result is affirmative. Therefore, in only the transmitting and receiving terminal 500 of golfer 1, the number of penalty strokes is reflected in the accumulative calculation.

The hole accumulated number of strokes, in which the number of penalty strokes is reflected, is transmitted to the hole accumulated number of strokes notification unit 670 through the hole accumulated number of strokes transmission unit 650, and is known to all team members as illustrated in FIG. 15*d*.

The hole accumulated number of strokes in which the number of penalty strokes are reflected may also be checked by the golfer 1 himself or herself through the hole accumulated number of strokes notification unit 631 by pressing a hole accumulated number of strokes check button 841 on his or her own transmitting and receiving terminal 500.

If the approach shot or the putting shot is not reflected in the hole accumulated number of strokes, the caddie may use the penalty stroke correction function to correct the hole accumulated number of strokes.

[Third Embodiment] Hitting Position Display Function and Hole Score Notification Function FIG. 16 is a block diagram illustrating a golf swing notification device according to a third embodiment of the present invention, which relates to a case where a hitting position notification function using GPS and a score notification function using a hole cup sensor 2 are further added in the golf swing notification device as illustrated to FIG. 7.

Hole Information Notification and Hole Accumulated Number of Strokes Reset Function Using GPS In FIG. 16, the hole information terminal 700 and the hole information terminal recognition unit 710 in FIG. 7 are not required, and instead, a GPS unit 1000 is installed.

The GPS unit 1000 not only calculates the current GPS position coordinates, but also have hole information and basic position information that has been input in advance and stored.

The hole information may include a name, a number of par, and the distance between the tee ground and the hole cup, which is the end point, of a hole, and the basic position information may include a position coordinate of the tee ground, a position coordinate of the hole cup, and a position coordinate of a green area.

The tee ground is the starting position of each hole and is a flat area of about 1.3 m×1.3 m (width×height), and considering the difference in skill and the flight distance between men and women, is usually provided in plural, such as 2 to 5, in the same hole.

It is preferable that the position coordinates of the green area are stored so that a closed curve border indicating the green border may be defined.

When a golfer enters the appropriate tee ground for himself or herself, based on the GPS position coordinates calculated through the GPS unit 1000, the fact that the golfer has entered the tee ground may be known through the position coordinates of the tee ground stored in the GPS unit 1000, and then the hole accumulated number of strokes reset unit 720 outputs a hole accumulated number of strokes reset signal to the accumulated number of strokes determination unit 610. At this time, the hole information notification unit 730 notifies the team members including the golfer himself or herself of the hole information, such as the name, the number of par, and the distance between the tee ground and the end point, which is the hole cup, of the hole stored in the GPS unit 1000.

Hitting Position Display Function Using GPS

The swing reception means 200 includes a map storage unit 1100 for storing a golf course map to which position coordinates are mapped, and a hitting position display unit 1200.

The GPS unit 1000 outputs, to the hitting position display unit 1200, GPS position coordinates at which a golf swing signal is generated, when the swing determination unit 110 outputs the golf swing signal.

The hitting position display unit 1200 receiving the GPS position coordinates displays a marker of the GPS position coordinates on the map as a hitting position marker.

Preferably, the hitting position display unit 1200 is installed to display a warning notification signal of the member identification code warning notification unit and the hole accumulated number of strokes of the hole accumulated number of strokes notification unit, together with the marker of the GPS position coordinates.

When the hitting position display unit 1200 displays the marker of the GPS position coordinates, the position marker of the team member wearing the golf swing notification device according to the present invention is also displayed on the map.

FIG. 17 is a view illustrating a hitting position display function using GPS, which shows a display screen of the golf swing notification device according to the present invention worn by each golfer when golfer 3 makes a golf swing for the third hit in the process of rounding at a par 4 hole by four golfers.

Specifically, FIG. 17*a* is a display screen of the golf swing notification device worn by golf 1, FIG. 17*b* is a display screen of the golf swing notification device worn by golfer 2, and FIG. 17*c* is a display screen of the golf swing notification device worn by golfer 3, and FIG. 17*d* is a display screen of the golf swing notification device worn by golfer 4.

Referring to FIG. 17*a*, since the position marker (circle marked 1) of golfer 1 is in front of the GPS position coordinate marker (yellow circle marked 3) of golfer 3, when a warning notification signal that golfer 3 is making a golf swing (for example, vibration) occurs, golfer 1 may intuitively quickly detect that he or she is in the position that may be hit by the ball through the golf swing notification device according to the present invention worn by him or her and be careful. In addition, golfer 1 may also see that the stroke of golfer 3 is the second.

Referring to FIG. 17*b*, golfer 2 may intuitively detect that he or she is in a position that may be hit by the ball and be careful. Golfer 2 may also see that the stroke of golfer 3 is the second.

Referring to FIG. 17*c*, golfer 3 may see that his or her stroke is the second with the warning notification signal.

Referring to FIG. 17*d*, golfer 4 may intuitively know that golfer 3 is making a golf swing in front of him or her when the warning notification signal occurs, and thus may predict that he or she will not be hit by the ball. Golfer 4 may also see that the stroke of golfer 3 is the second.

As described above, according to the present invention, when a golfer makes a golf swing, each of the team members may know where the golfer makes the golf swing with respect to their position, and thus the efficiency of the warning notification function may be improved.

Hole Score Notification Function

FIG. 18 is a view illustrating a hole cup sensor 2. The hole cup sensor 2 installed in a hole cup 1 detects a shock or vibration by a golf ball 3 when the golf ball 3 is holed in the hole cup, and transmits a hole-in signal to the hole accumulated number of strokes notification unit 670 of the swing reception means 200. Then, the hole accumulated number of strokes notification unit 670 recognizes that the rounding in the hole is over for the golfer who has taken the approach shot or the putting shot, and notifies all of the team members including the golfer of the hole score of the hole golfer in the corresponding hole.

In the related art, in many cases, a hole score is expressed through a golfer going out of the green area or manual manipulation of a caddie. However, by letting all team members know the hole score to at the moment the golf ball enters the hole cup as in the present invention, it is more intuitive and sensational, which may make the golf game more enjoyable.

INDUSTRIAL APPLICABILITY

According to the present invention, a caddie and other fellow golfers are able to know in advance that a golf swing was performed by a fellow golfer, so as to be warned to not be struck by a golf ball (hit warning notification function). In particular, the present invention is very useful in that it has an accumulated number of strokes notification and check function that enables a golfer and other fellow golfers to be notified of stroke count at all times during a round of golf, and also has a hole accumulated number of strokes reset function, a hole information notification function, a penalty stroke correction function, and the like.

Meanwhile, from the standpoint of each of team members, since the hit warning notification function would be more useful when the position of the person who has made the golf swing is behind the other team members than when the person who has made the golf swing is in front of the other team members, and thus it is important to know where the person who has made the golf swing is positioned relative to the position of each team member. According to the present invention, team members' own positions and the position of the person who has made the golf swing are displayed to each of the team members together, and thus each team member is able to know which side the person who has made the golf swing is positioned based on the team member.

The invention claimed is:

1. A golf swing notification device comprising:

a swing transmission means; and a swing reception means, the swing transmission means and the swing reception means being provided as a set to each of team members in each group during a round of golf, wherein the swing transmission means includes:

a swing determination unit determining whether or not a golf swing has been made and outputting a golf swing signal when the golf swing has been made;

an identification code storage unit storing a group identification code for identifying a group to which the swing transmission means belongs and a member identification code for identifying team members in the same group;

a transmission control unit outputting the group identification code and the member identification code stored in the identification code storage unit by using the golf swing signal as an input signal; and an identification code transmission unit receiving the group identification code and the member identification code output from the transmission control unit and transmitting the received codes to an outside, the swing reception means includes:

an identification code reception unit receiving the group identification code and the member identification code transmitted from the identification code transmission unit;

a group-specific integrated code storage unit storing a group identification code for identifying a group to which the swing reception means belongs and a group-specific member integrated code that is a code for all team members in the same group;

an identification code comparison and determination unit comparing the group identification code received by the identification code reception unit with the group identification code stored in the group-specific integrated code storage unit, determining whether or not the member identification code received by the identification code reception unit is included in the group-specific member integrated code stored in the group-specific integrated code storage unit when it is determined that the group identification codes are the same, and outputting the member identification code when the determination result is affirmative; and a member identification code warning notification unit outputting a warning notification signal corresponding to the member identification code output from the identification code comparison and determination unit to the outside, and when any one of team members of a group has played a golf swing, not only the team member who has played the golf swing but also other team members in the group are notified that the golf swing has been made.

2. The golf swing notification device of claim 1, wherein a notification transmission button is installed in the swing transmission means to manually input the golf swing signal at the transmission control unit.

3. The golf swing notification device of claim 1, wherein a sensitivity adjustment unit for adjusting sensitivity when the swing determination unit determines whether or not the golf swing has been made is installed in the swing transmission means.

4. The golf swing notification device of claim 1, wherein the golf swing is made through a hitting swing for actually striking a golf ball, or through a practice swing performed as a practice without hitting the golf ball prior to a hitting swing.

5. The golf swing notification device of claim 1, wherein the swing determination unit receives and presets a reference time interval or a reference position range through an external input, and outputs the golf swing signal once even if a plurality of golf swings are made within the reference time interval or the reference position range.

6. The golf swing notification device of claim 1, wherein the swing transmission means and the swing reception means are separately mounted on separate two-piece bodies, or are mounted together on a one-piece body.

7. The golf swing notification device of claim 1, wherein the swing transmission means further includes:

an accumulated number of strokes determination unit determining a hole accumulated number of strokes by accumulatively summing golf swings made in a current hole and determining a total accumulated number of strokes by summing the hole accumulated number of strokes in a previous hole and the hole accumulated number of strokes in the current hole;

an accumulated number of strokes storage unit storing the hole accumulated number of strokes and the total accumulated number of strokes calculated by the accumulated number of strokes determination unit; and a hole accumulated number of strokes transmission unit receiving a command to transmit the hole accumulated number of strokes which is output from the transmission control unit using the golf swing signal as an input signal and transmitting the hole accumulated number of strokes stored in the accumulated number of strokes storage unit to the outside, and the swing reception means includes:

a hole accumulated number of strokes reception unit receiving the hole accumulated number of strokes transmitted from the hole accumulated number of strokes transmission unit; and a hole accumulated number of strokes notification unit outputting the hole accumulated number of strokes received by the hole accumulated number of strokes reception unit in association with the member identification code output from the identification code comparison and determination unit.

8. The golf swing notification device of claim 7, wherein a reference time interval or a reference position range is preset by input in the accumulated number of strokes determination unit through an external input, and the accumulated number of strokes determination unit determines the hole accumulated number of strokes by treating a plurality of golf swings as one golf swing even if the plurality of golf swings are made within the reference time interval or the reference position range.

9. The golf swing notification device of claim 7, wherein the swing transmission means further includes:

an accumulated number of strokes notification unit giving notification of the hole accumulated number of strokes and the total accumulated number of strokes stored in the accumulated number of strokes storage unit to the outside; and an accumulated number of strokes check button for executing selective notification of the hole accumulated number of strokes and the total accumulated number of strokes through the accumulated number of strokes notification unit.

10. The golf swing notification device of claim 7, further comprising a hole information terminal installed on a tee ground that is a starting location of each hole and transmitting, to the outside, a hole terminal signal for giving notification of existence of the hole information terminal, wherein the swing transmission means further includes:

a hole information terminal recognition unit recognizing the hole information terminal signal; and a hole accumulated number of strokes reset unit outputting, to the accumulated number of strokes determination unit, a hole accumulated number of strokes reset signal for resetting the hole accumulated number of strokes to zero when the hole information terminal recognition unit recognizes the hole information terminal signal.

11. The golf swing notification device of claim 10, wherein the hole terminal signal includes hole information including a name, a number of par, and a distance between a tee ground and a hole cup that is an end point of the hole, and the accumulated number of strokes determination unit is installed to calculate the hole accumulated number of strokes by limiting a double value of the number of par obtained from the hole information to a maximum value when the hole information terminal signal is recognized by the hole information terminal recognition unit.

12. The golf swing notification device of claim 7, wherein the swing transmission means further includes:

a selected team member penalty stroke reflection unit installed to select a team member to be given a penalty stroke and increase or decrease the number of penalty strokes to be given to the selected team member;

a caddie terminal identification unit having a reference value for caddie identification preset by input through an external input, and activating the selected team member penalty stroke reflection unit through recognition as the caddie terminal when the reference value for caddie identification matches the group identification code and the member identification code of the identification code storage unit; and a selected team member penalty stroke transmission unit transmitting a selected team member selected by the selected team member penalty stroke reflection unit and the number of penalty strokes for the team member, as a penalty stroke signal, to an outside, and the accumulated number of strokes determination unit is installed to check whether or not the selected team member transmitted by being included in the penalty stroke signal transmitted from the penalty stroke transmission unit is a team member corresponding to the group identification code and the member identification code of the identification code storage unit and then reflects the number of penalty strokes for the selected team member in the calculation of the hole accumulated number of strokes when it is determined that the check result is affirmative.

13. The golf swing notification device of claim 7, wherein the swing transmission means further includes:

a GPS unit calculating GPS position coordinates and having basic position information including tee ground position coordinates preset by input; and an accumulated number of strokes reset unit recognizing that a golfer enters the tee ground through the tee ground position coordinates preset by input to the GPS unit based on the GPS position coordinates calculated by the GPUs unit, when the golfer enters the tee ground, and outputting, to the accumulated number of strokes determination unit, a hole accumulated number of strokes reset signal for resetting the hole accumulated number of strokes to zero.

14. The golf swing notification device of claim 13, wherein hole information including a name, a number of par, and a distance between a tee ground and a hole cup that is an end point of the hole is preset by input in the GPS unit, and the accumulated number of strokes determination unit is installed to calculate the hole accumulated number of strokes by limiting a double value of the number of par obtained from the hole information preset by input in the GPS unit to a maximum value when it is recognized that the golfer enters the tee ground through the GPS unit.

15. The golf swing notification device of claim 7, wherein the swing transmission means further includes a GPS unit calculating GPS position coordinates, and the swing reception means further includes a map storage unit storing a golf course map and a hitting position display unit, the GPS unit outputs, to the hitting position display unit, GPS position coordinates at which a golf swing signal is generated, when the swing determination unit outputs the golf swing signal, and the hitting position display unit displays a marker of the GPS position coordinates on the map.

16. The golf swing notification device of claim 15, wherein the hitting position display unit displays a warning notification signal of the member identification code warning notification unit and the hole accumulated number of strokes of the hole accumulated number of strokes notification unit, together with the marker of the GPS position coordinates.

17. The golf swing notification device of claim 15, wherein the hitting position display unit displays a marker of a position of a person who wears the swing transmission means and the swing reception means as a set, together with the marker of the GPS position coordinates on the map.

18. The golf swing notification device of claim 13, wherein a hole cup sensor is installed in the hole cup to detect that the golf ball is hole-in, a hole-in signal is transmitted to the hole accumulated number of strokes notification unit through the hole cup sensor when the golf ball is holed into the hole cup through an approach shot or a putting shot of a golfer, and the hole accumulated number of strokes notification unit that has received the hole-in signal is installed to recognize that rounding in the hole is over for the golfer and notify all team members including the golfer of a hole score of the golfer at the hole.

* * * * *